US010165822B2

(12) United States Patent
Magyar et al.

(10) Patent No.: US 10,165,822 B2
(45) Date of Patent: Jan. 1, 2019

(54) INSULATED FOOTWEAR ARTICLES

(71) Applicants: W. L. Gore & Associates, Inc., Newark, DE (US); W. L. Gore & Associati, S.r.l., Verona (IT)

(72) Inventors: Michael Magyar, Elkton, MD (US); Leslie Rikleen, Newark, DE (US); Eric O'Bryan, Greenville, DE (US); Andrea Giupponi, Venice (IT)

(73) Assignees: W. L. Gore & Associates, Inc., Newark, DE (US); W. L. Gore & Associati, S.r.l., Verona (IT)

( * ) Notice: Subject to any disclaimer, the term of this patent is extended or adjusted under 35 U.S.C. 154(b) by 40 days.

(21) Appl. No.: 15/299,001

(22) Filed: Oct. 20, 2016

(65) Prior Publication Data

US 2017/0112232 A1 Apr. 27, 2017

Related U.S. Application Data

(60) Provisional application No. 62/244,349, filed on Oct. 21, 2015.

(51) Int. Cl.

| | |
|---|---|
| ***A43B 7/34*** | (2006.01) |
| ***A43B 7/12*** | (2006.01) |
| ***A43B 23/07*** | (2006.01) |
| ***A43B 23/02*** | (2006.01) |
| ***A43B 23/08*** | (2006.01) |
| ***A43B 3/02*** | (2006.01) |

(52) U.S. Cl.

CPC ..... *A43B 7/34* (2013.01); *A43B 3/02* (2013.01); *A43B 7/125* (2013.01); *A43B 23/0205* (2013.01); *A43B 23/07* (2013.01); *A43B 23/081* (2013.01)

(58) Field of Classification Search

CPC ..... A43B 7/34; A43B 7/125; A43B 23/0205; A43B 23/07; A43B 23/081; A43B 3/02

See application file for complete search history.

(56) References Cited

U.S. PATENT DOCUMENTS

| | | | | |
|---|---|---|---|---|
| 4,055,699 | A | 10/1977 | Hsiung | |
| 7,118,801 | B2 | 10/2006 | Ristic-Lehmann | |
| 7,603,796 | B2 | 10/2009 | Johnson, Jr. | |
| 7,752,776 | B2 | 7/2010 | Farnworth | |
| 2004/0018336 | A1 * | 1/2004 | Farnworth ..... | A43B 7/34 428/71 |

(Continued)

FOREIGN PATENT DOCUMENTS

EP 0736267 A2 10/1996

OTHER PUBLICATIONS

International Search Report and Written Opinion for Application No. PCT/US2016/058141 dated Jan. 20, 2017.

*Primary Examiner* — Ted Kavanaugh
(74) *Attorney, Agent, or Firm* — Greenberg Traurig, LLP

(57) ABSTRACT

The invention is an article of footwear incorporating insulation material, such as a low bulk insulation material, to provide warmth in cold weather, yet with the style, agility, and breathability of a typical conventional shoe or boot. Additionally, in a further embodiment, the invention includes these features in a shoe or boot which is also waterproof and breathable. These aspects of the present invention are achieved through a placement, or mapping, of low bulk insulation to maximize the footwear article attributes of warmth, style, agility, and breathability.

30 Claims, 8 Drawing Sheets

(56) References Cited

U.S. PATENT DOCUMENTS

| | | | | |
|---|---|---|---|---|
| 2005/0281988 | A1* | 12/2005 | McCormick | A41D 31/0038 428/190 |
| 2006/0254088 | A1* | 11/2006 | McCormick | A41D 31/0038 36/44 |
| 2007/0128391 | A1 | 6/2007 | Giacobone et al. | |
| 2008/0197126 | A1* | 8/2008 | Bourke | A43B 7/025 219/634 |
| 2010/0122475 | A1* | 5/2010 | Purrington | A43B 17/003 36/3 B |
| 2014/0000130 | A1* | 1/2014 | Crist | A43B 7/04 36/136 |

* cited by examiner

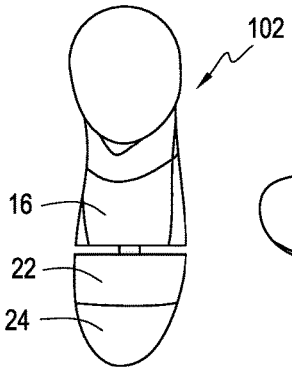
FIG. 2A
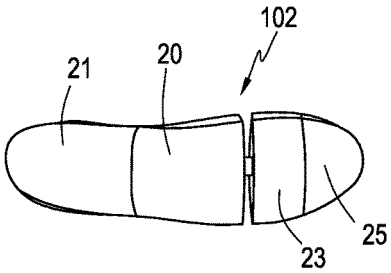
FIG. 2B
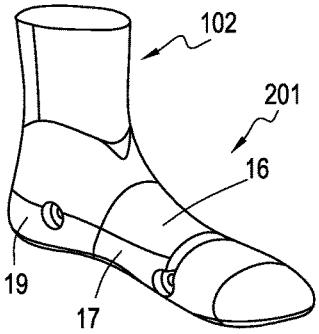
FIG. 2C
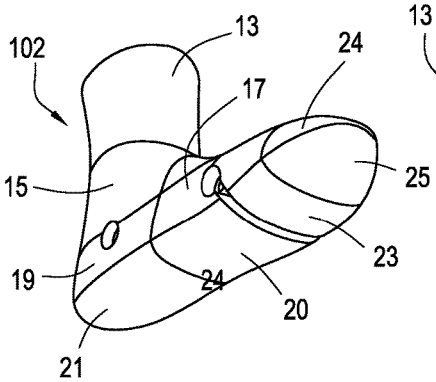
FIG. 2D
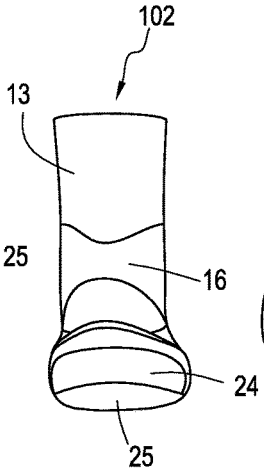
FIG. 2E
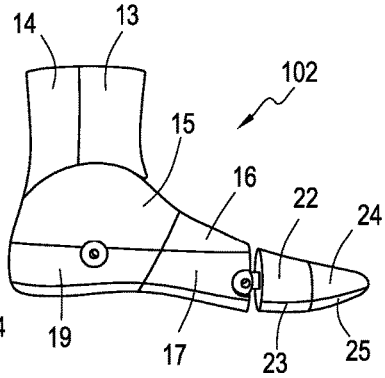
FIG. 2F
FIG. 2G
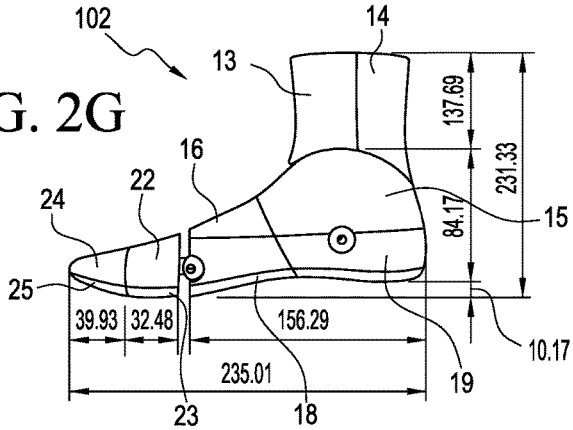
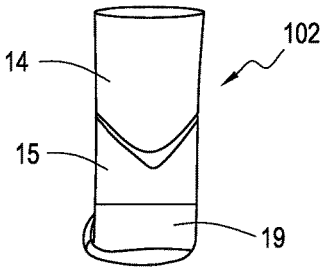
FIG. 2H FIG. 5
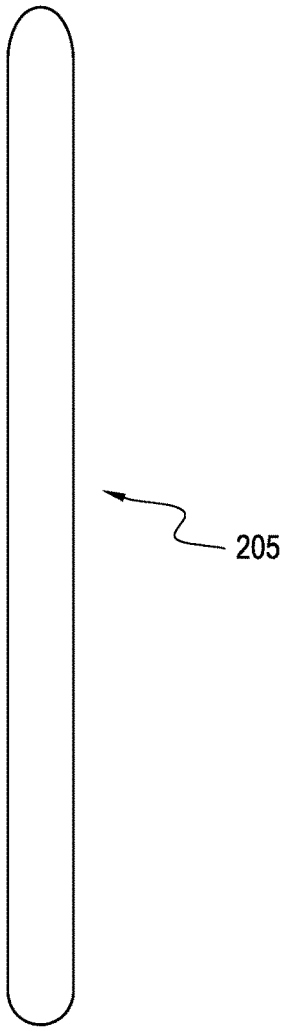
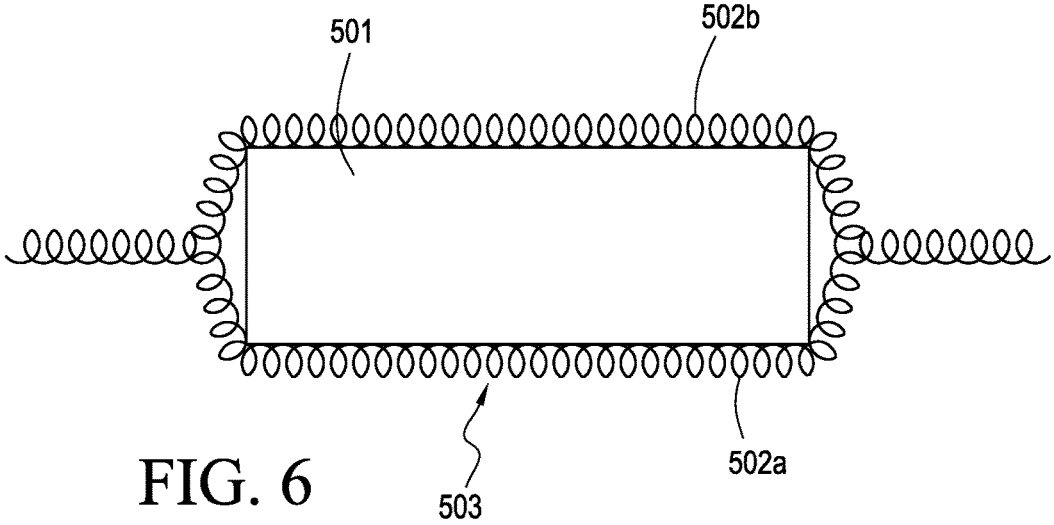
FIG. 6

INSULATED FOOTWEAR ARTICLES

CROSS REFERENCE TO RELATED APPLICATIONS

This patent application claims priority from U.S. Provisional App. No. 62/244,349, filed Oct. 21, 2015, the disclosure of which is incorporated herein by reference in its entirety.

FIELD OF THE INVENTION

The present invention relates generally to insulated footwear articles that provide warmth to the wearer without increased bulk relative to a conventional article of footwear.

BACKGROUND OF THE INVENTION

Use of thermal insulation in apparel is well known, with conventional materials consisting of batting, foam, down and the like. By way of example, insulation for footwear articles is known to include such materials as leather, felt, fleece, cork, flannel, foam, high loft batting and combinations thereof. A disadvantage of conventional insulating materials is that achieving high levels of insulation requires the use of a relatively large thickness of material. For example, adequate insulation in conventional footwear for sub-freezing temperatures can be on the order of several centimeters thick. In many applications for footwear used outdoors, the provision of a large thickness of material is impractical especially in apparel items for work or sport. In these activities, there often exists requirements of agility, surefootedness and firm traction for the feet. Too great a thickness of insulation introduces the possibility of relative motion between the body and the item being worn and hence an insecure contact with the ground. The aesthetics of an article may also be affected by added thickness and users may be averse to wearing bulky items of apparel which have an unflattering or unfashionable appearance. Additionally, the added bulk of conventional insulation tends to impact comfort and stiffness of the footwear to the wearer.

The art is replete with footwear constructions targeting adding insulation, particularly in the toe region, to enhance comfort and warmth of the toes. Several exemplary patents in the prior art are described in more detail below.

U.S. Pat. No. 4,055,699, in the name of Hsiung teaches a multi-layer insole for an article of footwear to insulate the foot from cold which is sufficiently thin to insulate without changing fit. The insole is a multi-layered laminate having a thin soft fabric layer laminated to the top of an open cell foam layer, a dense cross-linked polyolefin layer laminated to the foam layer, and an aluminum coated barrier layer of polymeric material laminated to the bottom of the cross-linked polyolefin layer. It is taught, however, that the insole is compressible and the open celled layer tends to pump air as body pressure is alternately applied, circulating warm air around the side of the foot within the shoe. Additionally, to increase insulation it is taught to increase the thickness of the open-celled layer.

The thermal conductivity of conventional insulation material used for apparel and footwear is generally greater than that of air which has a thermal conductivity of about 25 mW/m K at 25° C. In the case of high density materials such as neoprene foam, high conductivity may result from conduction by the solid component, or in materials of intermediate density, a combination of conduction, convection, and radiation mechanisms may result in higher effective conductivity. Conventionally, to substantially increase the level of insulation, a substantial increase in thickness of insulation material is required, which has the above-stated disadvantages such as changing the fit of an article.

U.S. Pat. No. 7,118,801, in the name of Ristic-Lehmann, is directed to material comprising aerogel particles and a polytetrafluoroethylene binder is formed having a thermal conductivity of less than or equal to 25 mW/m K at atmospheric conditions. The material is moldable or formable, having little or no shedding of filler particles, and may be formed into structures such as tapes or composites, for example, by bonding the material between two outer layers. These composites may be flexed, stretched, or bent without significant dusting or loss of insulating properties.

U.S. Pat. No. 7,752,776, in the name of Farnworth, is directed to articles of apparel comprising insulating components having insulating structures with low thermal conductivity. The insulating components have an insulating structure comprising a gas impermeable envelope and a porous material contained within the envelope where the insulating structure has a thermal conductivity of less than or equal to 25 mW/m K.

U.S. Pat. No. 7,603,796, in the name of Johnson, Jr. is directed to a boot, such as a hunting boot, having an oversized toe box within which a layer of cold weather insulating material of increased thickness is provided. According to the invention, a boot is provided with an oversized toe box where substantially more conventional high bulk, cold weather insulation is provided than a boot having a conventional toe box. Such oversized features have significant limitations in comfort, agility and appearance of boot for the wearer due to the larger size and bulk in the toe region.

US Pub. No. 2007/0128391, in the name of Giacobone, is directed to an insulating component having a layer of insulating material and a sealed envelope around the layer of insulating material, the envelope being made of elastomer material. The envelope is sealed by a peripheral weld. In a particular exemplary embodiment, the insulating component is part of an article of footwear, in which the component is positioned between an outer layer and an inner layer of a liner and is assembled to the upper by a seam along the peripheral weld.

European Patent Application Publication No. 0736267, to Pfister et al., is directed to a heat insulating footwear cap and footwear incorporating the cap. The heat insulating cap is lined with and consists of an air storing material which is so compression resistant that during normal use of the footwear the air storing capacity, and thus its heat insulating capacity, is maintained. Again, significant limitations exist with this footwear construction due to the added bulk in the toe region.

While these patents generally teach providing additional insulation incorporated within already highly insulated footwear, they do not provide for footwear articles which delivers agility, surefootedness and firm traction, along with attractive aesthetics and comfort of conventional uninsulated or minimally insulated shoes and boots (e.g., having upper thermal resistance values 0.18 $m^{2\circ}$ C./W or less).

There is a need for footwear which provides warmth without substantially changing the fit, appearance and comfort of a footwear article, whether a conventional insulated or uninsulated footwear article. There has been a long-felt need for low bulk insulating materials uniquely oriented in footwear articles to achieve such desired footwear.

SUMMARY OF THE INVENTION

It is an object of the invention to provide an article of footwear incorporating insulation, such as low bulk insulation, to provide warmth in cold weather, yet with the style, agility, and breathability of a typical conventional shoe or boot. Additionally, in a further embodiment, the invention includes these features in a shoe or boot which is also waterproof and breathable. These aspects of the present invention are achieved through a placement, or mapping, of low bulk insulation to maximize the footwear article attributes of warmth, style, agility, and breathability, as described in more detail herein.

In a first embodiment, the present invention is directed to an insulated footwear article comprising an upper region, a toe region comprising a toe top region and toe bottom region, and a foot bottom region, wherein the footwear article has an upper region footwear thermal resistance $R_f$ of 0.18 $m^{2\circ}$ C./W or less and incorporates insulation, such as low bulk insulation, with a thermal conductivity of 30 mW/m° C. or less, e.g., 25 mW/m° C. or less, in the toe top region, and wherein the footwear article has a toe region to foot bottom region footwear thermal resistance ratio of 0.80 or greater, e.g., 0.90 or greater. The footwear thermal resistance $R_f$ of each region may be measured in accordance with the general teachings of ASTM F1291-10, modified for footwear as described herein. In a further embodiment of the invention, the footwear article may have an upper region footwear thermal resistance $R_f$ of 0.16 $m^{2\circ}$ C./W or less, or 0.1 $m^{2\circ}$ C./W or less for uninsulated or little insulation. In further alternative embodiments, the footwear article may have a toe region to foot bottom region footwear thermal resistance ratio of 1.0 or greater, and alternatively of 1.2 or greater. In certain embodiments, the footwear article may be waterproof and may also be breathable. In another embodiment of the invention, the footwear article has an upper region footwear evaporative resistance of 250 $m^2$·Pa/W or less, e.g., 150 $m^2$·Pa/W or less or 100 $m^2$·Pa/W or less. In one embodiment, the low bulk insulation is present within the toe top region and is absent or not present in the upper, toe bottom or foot bottom regions. The insulation present in the toe top region may be continuous. In one embodiment, the low bulk insulation comprises an aerogel containing material. In one embodiment, the low bulk insulation may have a thickness of less than or equal to 5 mm, e.g., less than or equal to 3 mm.

In a further embodiment of the present invention, there is provided an insulated footwear article comprising an upper region, a toe region comprising a toe top region and toe bottom region, and a foot bottom region, wherein the footwear article has an upper region footwear thermal resistance $R_f$ of 0.18 $m^{2\circ}$ C./W or less and incorporates low bulk insulation with a thermal conductivity of 30 mW/m° C. or less, e.g., 25 mW/m° C. or less, in the toe top region, and the low bulk insulation comprises an aerogel containing material. In one embodiment, the low bulk insulation may have a thickness of less than or equal to 5 mm, e.g., less than or equal to 3 mm.

In yet a further embodiment of the present invention, there is provided an insulated footwear article comprising an upper region, a toe region comprising a toe top region and toe bottom region, and a foot bottom region, wherein the footwear article has an upper region footwear thermal resistance $R_f$ of 0.18 $m^{2\circ}$ C./W or less and incorporates low bulk insulation with a thermal conductivity of about 30 mW/m° C. or less, e.g., 25 mW/m° C. or less, in the toe top region, and the low bulk insulation has a compression resistant value of less than 40% strain at a stress of 300 kPa. In other embodiments, the insulation has a compression resistant value of less than 55% strain at a stress of 2000 kPa. In one embodiment, the insulation may be a low bulk insulation having a thickness of less than or equal to 5 mm, e.g., less than or equal to 3 mm.

In another embodiment of the present invention, there is provided an insulated footwear article comprising a toe top region and an upper region, wherein the footwear article has an upper region footwear thermal resistance $R_f$ of 0.18 $m^{2\circ}$ C./W or less in the toe top region and incorporates insulation, such as low bulk insulation, with a thermal conductivity of about 30 mW/m° C. or less, e.g., 25 mW/m° C. or less, in the toe top region, and further wherein the footwear article has an toe top region to upper region footwear thermal resistance ratio of 1.0 or greater. In an alternative embodiment of the invention, the footwear article of has an upper region footwear thermal resistance of 0.16 $m^{2\circ}$ C./W or less, and alternatively, 0.1 $m^{2\circ}$ C./W or less. In an additional embodiment, the footwear article has a toe top region to upper region footwear thermal resistance ratio of 1.4 or greater as measured in accordance with the general teachings of ASTM F1291-10, e.g., 1.7 or greater. Depending on the performance requirements, in certain embodiments of the invention, the footwear article may be waterproof, may be breathable, or may be both waterproof and breathable. In a further embodiment, the footwear article has an upper region footwear evaporative resistance of 250 $m^2$·Pa/W or less, e.g., 150 $m^2$·Pa/W or less or 100 $m^2$·Pa/W or less. In one embodiment, the low bulk insulation is present within the toe top region is and absent or not present in the upper, toe bottom or foot bottom regions. The low bulk insulation present in the toe top region may be continuous. In one embodiment, the low bulk insulation comprises an aerogel containing material. In one embodiment, the low bulk insulation may have a thickness of less than or equal to 5 mm, e.g., less than or equal to 3 mm.

In a further embodiment of the present invention, a footwear article is provided comprising a toe top region and an upper region, wherein the footwear article incorporates insulation with a thermal conductivity of 30 mW/m° C. or less, e.g., 25 mW/m° C. or less, in the toe top region and the footwear article has an upper region footwear evaporative resistance of 150 $m^2$·Pa/W or less, e.g. 100 $m^2$·Pa/W. For footwear having evaporative resistance of less than 150 $m^2$·Pa/W the breathability is improved. The desirable comfort and performance of the footwear may also determine the breathability. In alternative embodiments, the footwear article comprises an upper region footwear evaporative resistance of 75 $m^2$·Pa/W or less, and alternatively even 50 $m^2$·Pa/W or less. In another embodiment, the footwear article may also comprise an upper region footwear thermal resistance $R_f$ of 0.18 $m^{2\circ}$ C./W or less, and even 0.16 $m^{2\circ}$ C./W or less, or even 0.1 $m^{2\circ}$ C./W or less. The footwear article may also be waterproof in certain embodiments. In one embodiment, the low bulk insulation is present within the toe top region is and absent or not present in the upper, toe bottom or foot bottom regions. The low bulk insulation present in the toe top region may be continuous. In one embodiment, the low bulk insulation comprises an aerogel containing material. In one embodiment, the low bulk insulation may have a thickness of less than or equal to 5 mm, e.g., less than or equal to 3 mm.

In still another embodiment, there is provided a method of forming a footwear article comprising an upper region, a toe region comprising a toe top region and toe bottom region, and a foot bottom region, the method comprising incorporating a low bulk insulation with a thermal conductivity of 30 mW/m° C. or less, e.g., 25 mW/m° C., or less in at least a portion of the toe region of said footwear article, whereby said footwear article has an upper region footwear thermal resistance $R_f$ of 0.18 $m^{2\circ}$ C./W or less and a toe region to foot bottom region footwear thermal resistance ratio of 0.80 or greater, e.g., 0.90 or greater or 1.0 or greater.

These and other features are describe in more detail herein.

Definitions

"Low bulk insulation" as used herein is intended to refer to insulation having a thermal conductivity of 30 mW/m° C. or less, e.g., 25 mW/m° C. or less, at atmospheric conditions. As used herein, air is not to be considered within the scope of the term low bulk insulation. Compared to traditional footwear loft insulation (e.g., Thinsulate™ insulation, Primaloft® insulation, etc.), which has a thermal conductivity of 40 mW/m° C. or more, low bulk insulation has an equivalent thermal resistance at significantly lower thickness. In certain embodiments, low bulk insulation has a thickness of less than or equal to 5 mm, e.g., less than or equal to 3 mm, less than or equal to 2 mm, less than or equal to 1 mm or less than or equal to 0.5 mm. In terms of ranges low bulk insulation has a thickness of 0.2 to 5 mm, e.g. 0.2 to 3 mm or 0.2 to 2.5 mm.

"Incorporated" means affixed in the footwear, not a separate insert.

"Continuous" as used herein is intended to mean covering an area or region, and continuous coverage may be achieved with a single piece or multiple pieces abutting or substantially abutting, and may also include multiple pieces of materials which are overlapped to provide the continuous coverage. A continuous coverage does not have gaps to allow heat to escape along a direct path. In certain embodiments, the low bulk insulation may be continuous in the toe region and in other embodiments may be continuous in the toe top region.

"Waterproof" means the footwear article meets the Footwear Waterproofness Centrifuge Test provided herein.

"Gas permeable" means having a gas permeability of greater than $10^{-3}$ g/$m^2$ atmosphere/day, as measured based on the test provided in the Test Methods.

"Breathability" is a measure of the permeability of water vapor through footwear which can be measured by a number of different methods. As one example, ASTM F2370, *Standard Test Method for Measuring the Evaporative Resistance of Clothing Using a Sweating Manikin*, included in the Test Methods herein, measures the inverse of permeability (i.e. evaporative resistance) such that footwear of higher permeability or breathability would have lower evaporative resistance values.

Footwear articles as referred to herein include shoes of all sizes and constructions, including but not limited to boots, heeled shoes, flats, ballerinas, pumps, loafers and also socks. The terms "shoe" and "boot" may be used herein interchangeably to refer to footwear articles.

"Toe puff" as used herein describes a piece of material inserted as a stiffener material in the toe of the footwear article between the outside of the footwear article and the lining.

BRIEF DESCRIPTIONS OF FIGURES

The advantages of this invention will be apparent upon consideration of the following detailed disclosure of the invention, especially when taken in conjunction with the accompanying drawings wherein:

FIGS. 1*a-h* are schematic illustrations depicting various perspective views of a foot manikin testing device component with size 42 foot manikin regions identified which correspond to footwear regions of the present invention, wherein FIG. 1*a* is a top perspective view of the foot manikin;

FIG. 1*b* is a bottom perspective view of the foot manikin;

FIG. 1*c* is a top angled side perspective view of the foot manikin;

FIG. 1*d* is a bottom angled side perspective view of the foot manikin;

FIG. 1*e* is a front perspective view of the foot manikin;

FIG. 1*f* is a side perspective view of the foot manikin;

FIG. 1*g* is another side perspective view of the foot manikin on the side opposite to that shown in FIG. 1*f*, with dimensions indicated in millimeters; and FIG. 1*h* is a rear perspective view of the foot manikin;

FIGS. 2*a-h* are schematic illustrations depicting various perspective views of a foot manikin testing device component with size 37 foot manikin regions identified which correspond to footwear regions of the present invention, wherein FIG. 2*a* is a top perspective view of the foot manikin;

FIG. 2*b* is a bottom perspective view of the foot manikin;

FIG. 2*c* is a top angled side perspective view of the foot manikin;

FIG. 2*d* is a bottom angled side perspective view of the foot manikin;

FIG. 2*e* is a front perspective view of the foot manikin;

FIG. 2*f* is a side perspective view of the foot manikin;

FIG. 2*g* is another side perspective view of the foot manikin on the side opposite to that shown in FIG. 2*f*, with dimensions indicated in millimeters; and FIG. 2*h* is a rear perspective view of the foot manikin;

FIG. 5 is a side cross-sectional perspective view of the footbed shown;

FIG. 6 is a side cross-sectional view of an insulation construct in accordance with embodiments of the present invention;

Figure 7A:
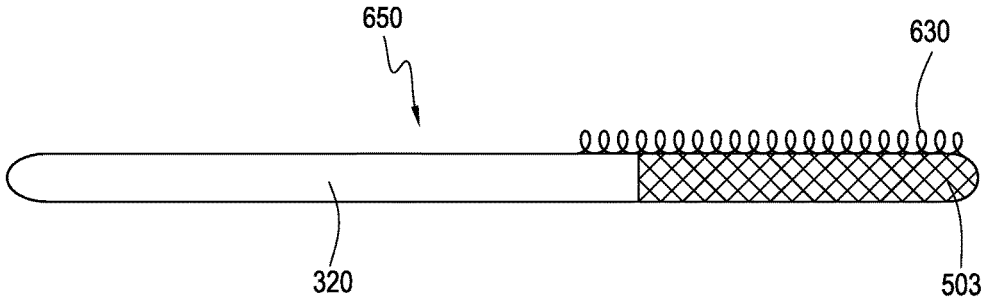
Figure 7B:
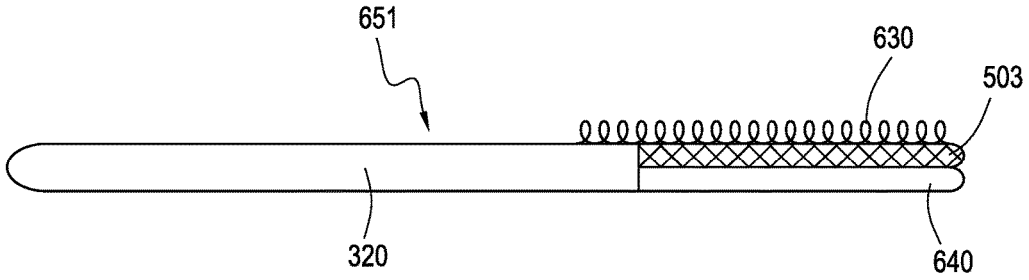
Figure 8:
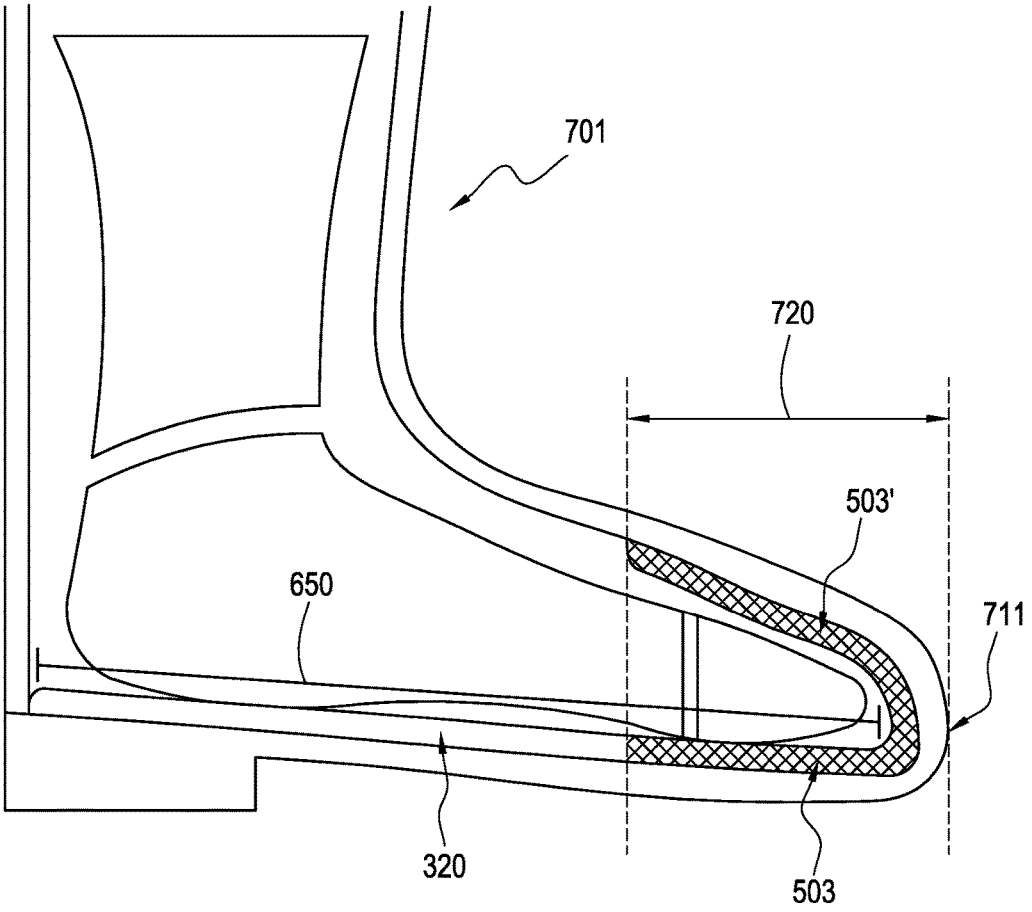
Figure 9:
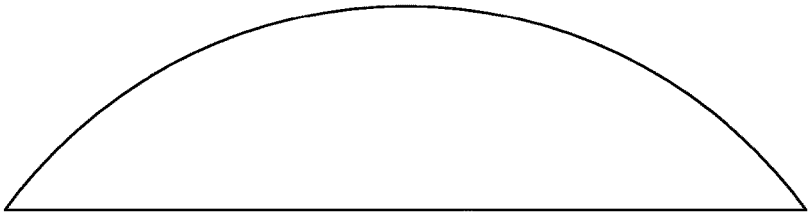
Figure 10:
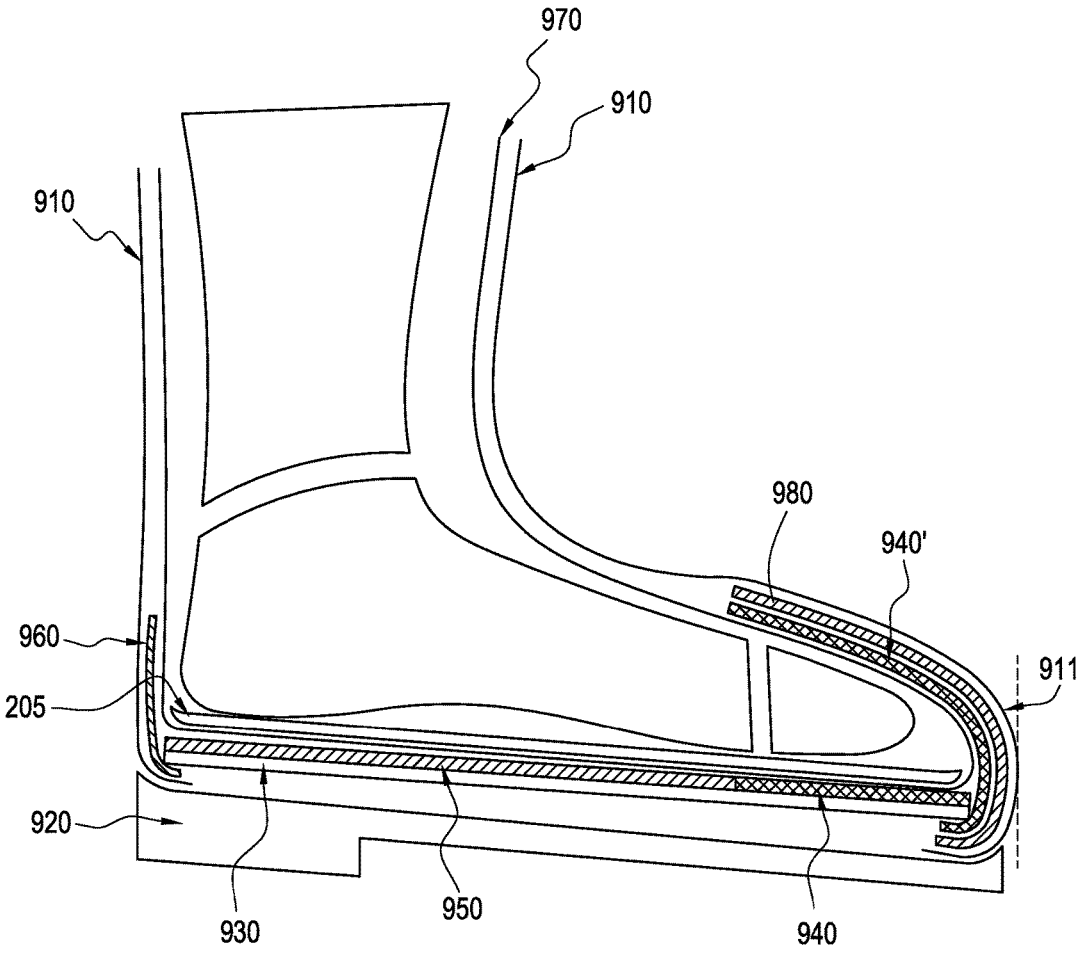
Figure 11:
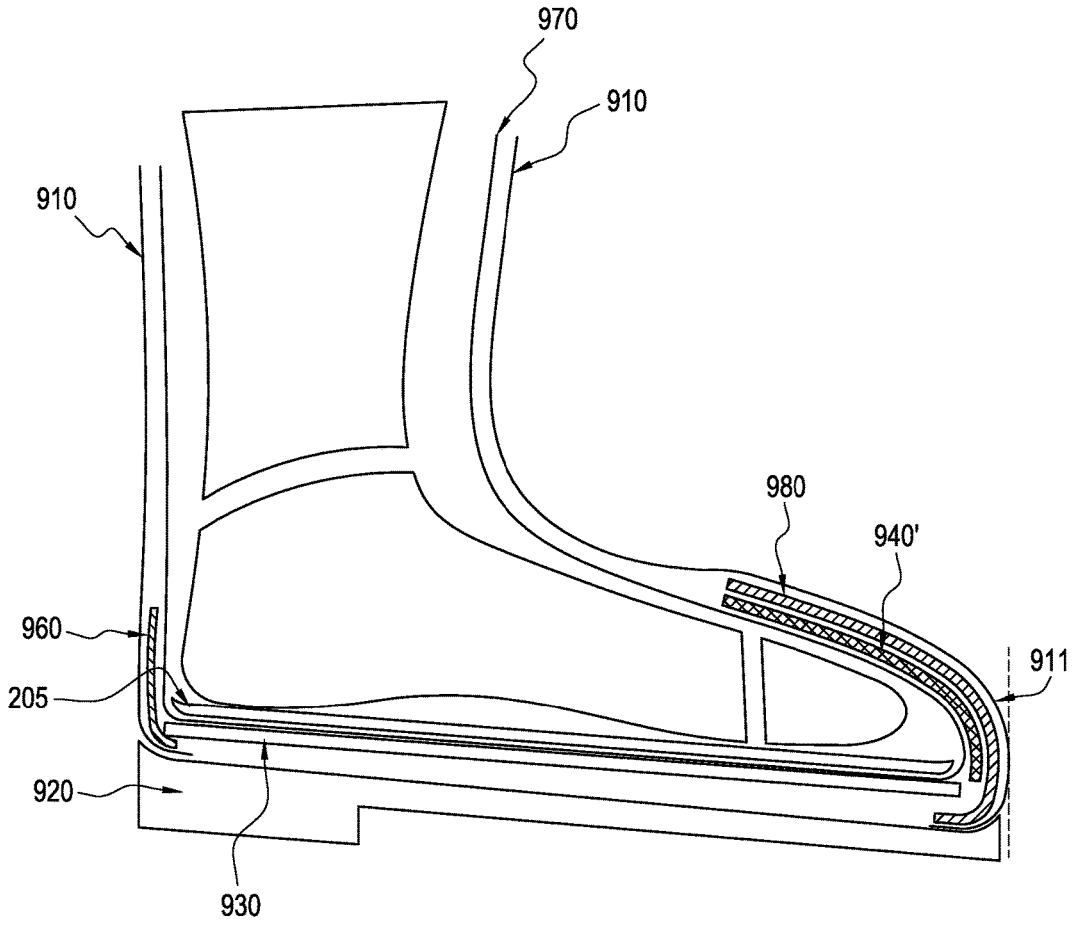

FIG. 7*a* is a side cross-sectional view of an embodiment of a footbed incorporating an insulation construct in accordance with embodiments of the present invention;

FIG. 7*b* is a side cross-sectional view of an alternative embodiment of a footbed incorporating an insulation construct in accordance with embodiments of the present invention;

FIG. 8 is a side cross-sectional view of a footwear article of embodiments of the present invention;

FIG. 9 is a top view of an insulation construct in accordance with one embodiment of the present invention;

FIG. 10 is a side cross-sectional view of an embodiment of a footwear article having insulation in the toe region in accordance with the present invention; and FIG. 11 is a side cross-sectional view of an embodiment of a footwear article having insulation in the toe top region in accordance with the present invention.

DETAILED DESCRIPTION OF THE INVENTION

The present invention is directed to footwear which provides warmth without substantially changing the fit, appearance and comfort of a footwear article, whether a conventional insulated or uninsulated footwear article. The invention incorporates low bulk insulation oriented in footwear articles to achieve such desired footwear. It is an object of the invention to provide a warm article of footwear with the style, agility, and breathability of typical conventional shoes and boots which have little or no insulation. It is a further object of the invention to provide methods of manufacturing such articles of footwear. Additionally, it is an object of the invention to provide these insulating features in a shoe or boot which is also waterproof and breathable.

Figure 1A:
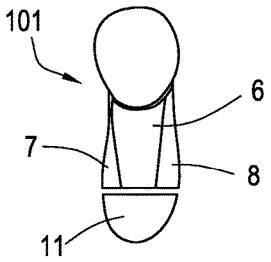
Figure 1B:
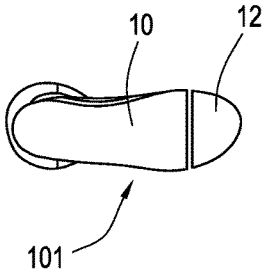
Figure 1C:
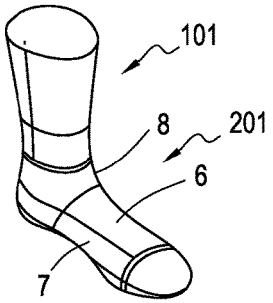
Figure 1D:
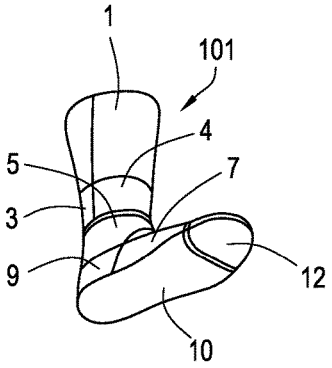
Figure 1E:
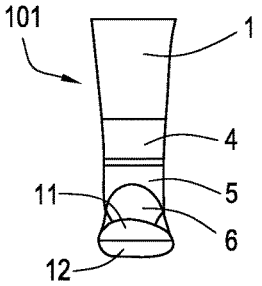
Figure 1F:
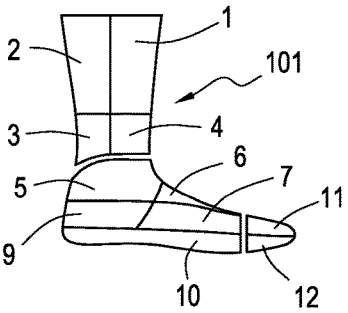
Figure 1G:
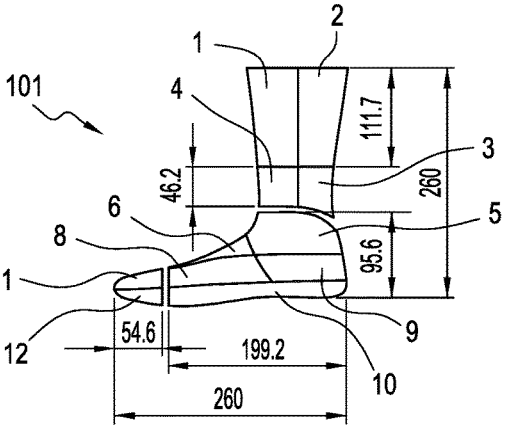
Figure 1H:
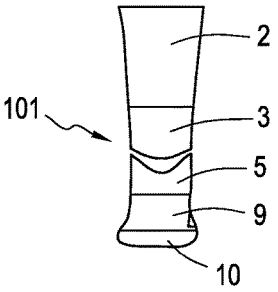

Measuring performance of footwear articles for comfort and performance is generally carried out through the use of testing equipment incorporating a foot manikin and one or more measurement devices for measuring the performance of a footwear article under controlled conditions. The testing manikins are typically identified with zones, for example, such as are identified in the various perspective views of a foot manikin 101 as shown in FIGS. 1*a*-1*h* and described in the corresponding Table 1, provided in the Test Methods section contained herein. FIGS. 1*g* and 2*g* includes measure bars with dimensions (mm) for a particular foot manikin, as described in more detail in the Test Methods section.

Figure 3:
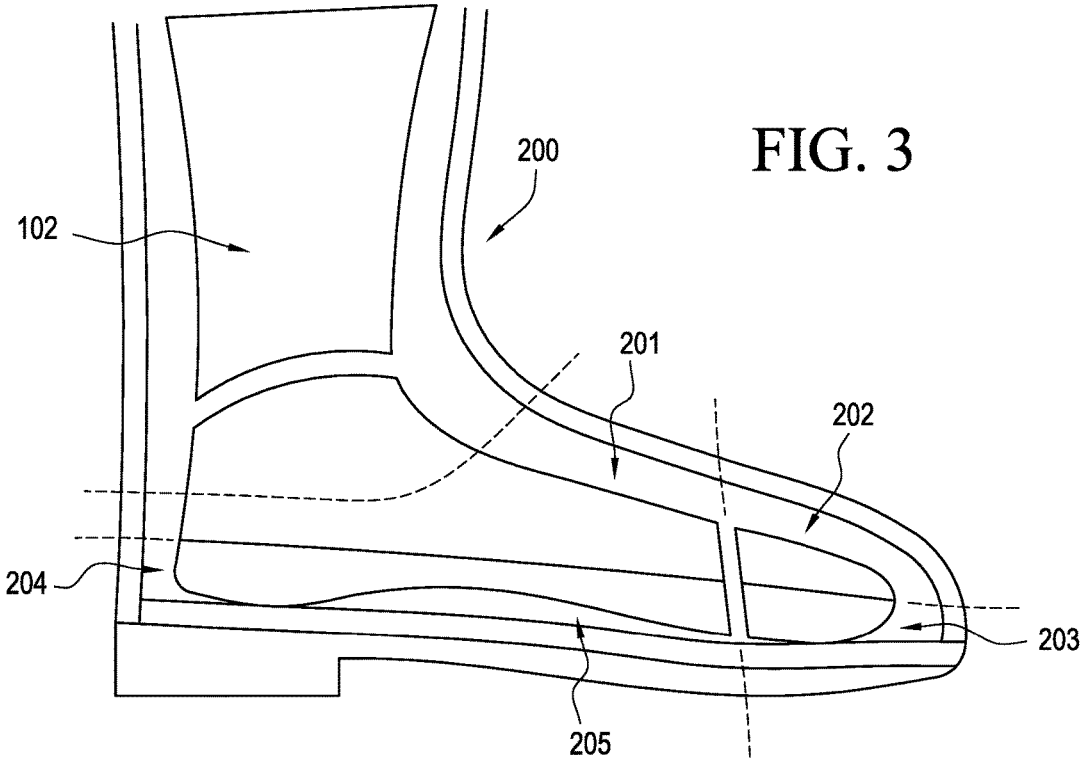
FIG. 3 is a side cross-sectional perspective view of the foot manikin inside a conventional footwear article.

Footwear regions correlate generally to the foot manikin zones identified in FIGS. 1*a*-1*h* for foot manikin 101 and zones identified in FIGS. 2*a*-2*h* for foot manikin 102. The regions may also correlate to a conventional footwear article 200 shown in FIG. 3. In accordance with one embodiment of the present invention, a footwear upper region 201 is identified as having material covering a region of the foot correlated with at least one of zones 6, 7, 8 and 9 of the foot manikin 101 shown in FIGS. 1*a*-1*h*. In certain embodiments, the upper region 201 comprises each of zones 6, 7, 8, and 9, and in other embodiments there may be partial coverage in one or more of these zones depending on the type of shoe. Even where there is partial coverage, as long as at least a portion of the upper region is covered by a material, that region has a thermal resistance of 0.18 $m^{2\circ}$ C./W or less. It should be understood that when there is partial coverage or no coverage the thermal resistance is poor and the ratio between the toe region and upper region is greater. For some types of footwear, such as boots, the upper region 201 may also comprise one or more of zones 1, 2, 3, 4, and/or 5. Other footwear such as ballerina flats or loafers may have partial coverage of material in some zones while other zones have no material.

A toe top region in accordance with one embodiment of the present invention is identified as having material covering a region of the foot correlated with zone 11 of the foot manikin 101 shown in FIGS. 1*a*-1*h*. A toe region in accordance with one embodiment of the present invention is identified as having material covering a region of the foot correlated with zones (toe top) 11 and (toe bottom) 12 of the foot manikin shown in FIGS. 1*a*-1*h*, and shown as the region encompassed by 202 and 203 in FIG. 3. A foot bottom region in accordance with one embodiment of the present invention is identified as having material covering a region of the foot correlated with zone 10 of the foot manikin shown in FIGS. 1*a*-1*h*, and is shown as 204 in FIG. 3.

It would be appreciated by one of skill in the art that the boundaries of the defined footwear regions may vary slightly depending on the style, size and construction of the particular footwear. In one embodiment, a footwear upper region 201 is identified as having material covering a region of the foot correlated with at least one of zones 16, 17, 18, 19, and 22 of the foot manikin 102 shown in FIGS. 2*a*-2*h*. In certain embodiments, the upper region 201 comprises each of zones 16, 17, 18, 19, and 22, and in other embodiments there may be partial coverage in one or more of these zones depending on the type of shoe. For some types of footwear, such as boots, the upper region 201 may also comprise one or more of zones 13, 14, and/or 15. A toe top region in accordance with one embodiment of the present invention is identified as having material covering a region of the foot correlated with zone 24 of the foot manikin 102 shown in FIGS. 2*a*-2*h*. A toe region in accordance with one embodiment of the present invention is identified as having material covering a region of the foot correlated with zones (toe top) 24 and (toe bottom) 25 of the foot manikin shown in FIGS. 2*a*-2*h*, and shown as the region encompassed by 202 and 203 in FIG. 3. A foot bottom region in accordance with one embodiment of the present invention is identified as having material covering a region of the foot correlated with zones 20, 21 and 23 of the foot manikin shown in FIGS. 2*a*-2*h*, and is shown as 204 in FIG. 3.

In one embodiment, the thermal resistance ratio of toe region to foot bottom region footwear is 0.80 or greater, e.g., 0.90 or greater or 1.0 or greater. The thermal resistance ratio of toe region to foot bottom region may be applicable to several different shoe constructions. In one exemplary embodiment, the toe region footwear thermal resistance of 0.07 $m^{2\circ}$ C./W or greater, e.g., from 0.07 to 0.3 $m^{2\circ}$ C./W. In terms of ranges, the foot bottom region footwear may have a thermal resistance from 0.09 $m^{2\circ}$ C./W or greater, e.g., from 0.09 to 0.24 $m^{2\circ}$ C./W.

Figure 4:
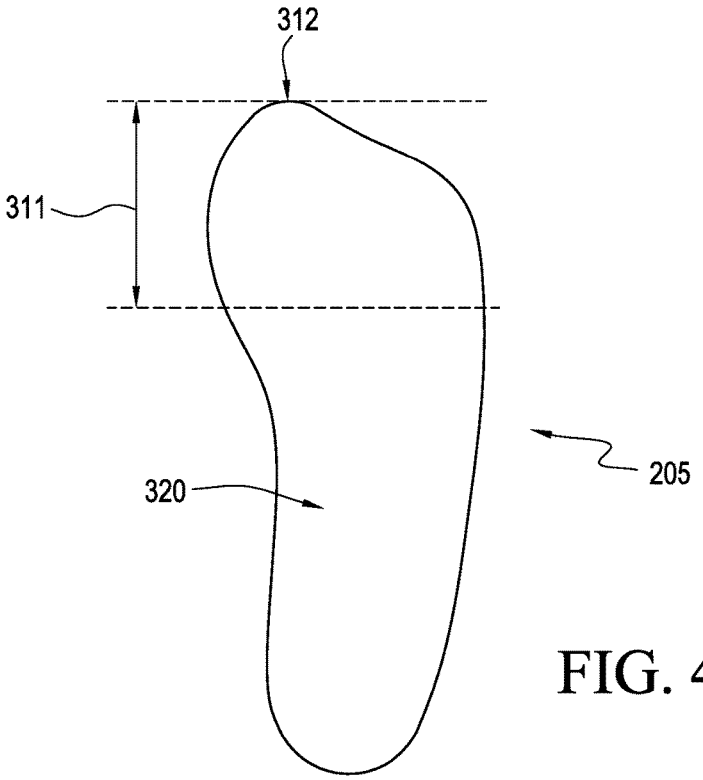
FIG. 4 is a top perspective view of a footbed shown in side cross-sectional view.

Referring to FIG. 4, there is shown a schematic of a top view of a conventional footbed 205 for a shoe, wherein the region 311 defines the footbed toe between the dotted lines. FIG. 5 shows a side cross-sectional perspective view of the conventional footbed 205.

FIG. 6 is a schematic of the cross-section of one suitable low bulk insulation material construction for use as a component of the present invention, wherein the insulation 501 is within the two covering layers 502*a* and 502*b*. This combination of low bulk insulation material and covering layers is hereafter referred to as an insulation construct 503. The insulation construct 503 used in the footwear toe top region of a shoe or boot, as described above, may be referred to in some instances as the "upper insulation construct," and the insulation construct used in the bottom of the toe region of a shoe or boot, as described above, may be referred to in some instances as the "sole insulation construct."

Suitable low bulk insulations for use in the present invention may include, but are not limited to, aerogel containing materials, vacuum panels, and other suitable insulation with a thermal conductivity of 30 mW/m° C. or less, e.g., 25 mW/m° C. or less. In certain embodiments, the low bulk insulation may comprise an aerogel and polymeric film binder, such as PTFE. In certain embodiments, the low bulk insulation may comprise an aerogel/fluoropolymer particle matrix as described in U.S. Pat. No. 7,118,801, the entire contents and disclosures of which are incorporated by reference. The aerogel/fluoropolymer particle matrix comprises greater than or equal to 40 wt. % aerogel particles and less than or equal to 60 wt. % polytetrafluoroethylene particle having a particle size from 50 to 600 μm. In one embodiment, the aerogel/fluoropolymer particle matrix may have a thermal conductivity of 25 mW/m° C. or less.

In one embodiment, the insulation may be adhered with the upper or the lining or any other part of the footwear, e.g. a toe puff or form a part of a laminate e.g. a waterproof, breathable laminate within the footwear article. The insulation may be adhered with a suitable adhesive or sewn into the footwear article or be placed within a pocket attached to a part of the footwear article.

In certain embodiments, suitable insulation materials include those that do not undesirably add bulk. Suitable insulation materials also are able to conform to the shape of the shoe without significantly affecting conform and fit of the shoe, e.g., wrinkling, or affecting smoothness. The insulation materials may in certain embodiments be molded or otherwise shaped to conform to the contours of the footwear article. It is to be understood that air gaps that may exist in conventional footwear would not constitute low bulk insulation in accordance with the invention. Moreover, depending on the particular embodiment of a footwear article of the invention, the low bulk insulation may be located in only a portion or portions of the particular footwear region, or the low bulk insulation construct may completely cover the particular footwear region. Further, depending on the particular embodiment, one or more insulation constructs may be located in a particular footwear region (e.g., single piece or multiple pieces) to cover the region and to provide insulation in accordance with the present invention. Additionally, in certain embodiments, it may be desirable that the low bulk insulation comprise a gas permeable material. Suitable optional covering materials may be used to provide a cover layer in the insulation construct and may include films, textiles, membranes, leathers, or the like, either as single layers or multi-layers, for isolating the low bulk insulation within the footwear article. Depending on the low bulk insulation used in a particular embodiment of the invention, the covering material may provide protection for the insulation in use (e.g., from abrasion, etc.), may minimize dusting of the insulation, may assist in maintaining vacuum or other performance of the insulation, and the like.

In certain embodiments, the low bulk insulation is able to withstand compression during normal use from wearing the shoe and higher compressions typically associated with manufacturing or construction of the shoe. It is advantageous for insulation to withstand compression to avoid damage or degradation of the thermal properties. In one embodiment, the low bulk insulation has a compression that has less than 40% strain at a stress of 300 kPa, which is typically associated with normal use. During manufacturing or construction of the shoe the compression is higher and the low bulk insulation has less than 55% strain at a stress of 2000 kPa. It is surprising that the low bulk insulation has a lower strain and thermal conductivity of 30 mW/m° C. or less. Traditional footwear loft insulation (e.g., Duratherm™ insulation, Thinsulate™ insulation, Primaloft® insulation, etc.) has a compression greater than 40% strain under normal use and greater than 55% associated with manufacturing or construction of the shoe. Because the strain is greater during manufacturing or construction it is expected that the thermal resistance of these traditional loft insulations would be lower and the thermal ratio would be lower for the same thickness as the low bulk insulation used in embodiments of the present invention.

Referring to FIG. 7*a*, there is shown a first insulation construct 503 located adjacent a footbed rear section 320, so that the two pieces together assume the general shape of the original footbed (shown in FIG. 4 as 205). A textile or other connecting material 630, for example, such as the material comprising the covering material for the insulation construct, is oriented and affixed atop the insulation construct 503 and the footbed rear section 320 so that it spans the interface between the two. In some embodiments, the connecting material 630 may extend the length of footbed rear section 320. The resulting structure comprises a modified footbed 650 in accordance with the present invention. In certain embodiments, the low bulk insulation is added in the modified footbed 650 without increasing the thickness of the original footbed as in FIG. 4 as 205. This allows the modified footbed 650 to maintain a low profile and may be used in shoes without increasing bulk or thickness. In still further embodiments, the modified footbed 650 may be the insole of the shoe and the insulation construct may be located within the insole.

FIG. 7B shows and alternate embodiment of a modified footbed 651 of the invention wherein a spacer 640 is oriented below the insulation construct 503. In other embodiments, spacer 640 may be oriented above the insulation construct 503. For example, in certain embodiments of the present invention wherein the footbed material 320 is thicker (e.g., at least 0.5 mm thicker) than the thickness of the insulation construct 503, it may be desirable to include such a spacer in the construction. Suitable spacers may include materials which fill the otherwise void area without adding unnecessary weight or bulk, such as foams, corrugated structures, scrims and the like.

FIG. 8 is a schematic cross-sectional view showing a foot manikin 101 of FIG. 1*a*-1*h* or 102 of FIGS. 2*a*-2*h*, as described earlier, located in a footwear article 701 of the present invention. The modified footbed 650, comprising the footbed rear section 320 and the insulation construct 503, is shown oriented within the footwear article 701. An additional insulation construct 503' is oriented in the footwear article 701, as shown. The shape of the additional insulation construct 503' is typically made such that it generally fits the upper portion of the toe cavity as depicted by the arrow extending between the dotted lines 720 of the footwear article 701. In one embodiment, a unitary insulation construct may comprise insulation construct 503 and additional insulation construct 503'. In other embodiments, insulation construct 503 and additional insulation construct 503' are separate and may be joined together or arranged in an overlapping configuration depending on the shoe construction. FIG. 9 shows a top view of a suitable insulation construct 503' in one embodiment of the present invention having a domed shape. For embodiments incorporating an upper insulation construct 503' shown in FIG. 9, it would be appreciated that the curved edge would be oriented toward the front of the footwear article, generally contacting the perimeter of the footbed 650 within the footbed toe region 311 (referring generally to FIG. 3). It should be appreciated that the insulation constructs substantially cover at least a region of the shoe corresponding to the toe top region, regardless of the specific footbed construction, insulation construct shape, orientation of a bottom insulation construct in or below the footbed and orientation of an upper insulation construct between or under regions or layers of the upper, etc.

FIG. 10 shows a side cross-sectional view of one embodiment of a footwear article construction of the present invention. In this embodiment, the insulation components 940 and 940' are oriented outside relative to the footbed 205 and the lining 970. In one embodiment, the lining 970 may be a functional layer made out of a fluoropolymer. The overall footwear article for this embodiment also comprises an upper material 910, a sole 920, an insole board 930 beneath the insulation 940 and textile component 950, a heel counter 960 and a toe puff 980. In other embodiments, insulation 940 may be adhered to the insole board 930 along textile component 950 to form a surface of approximately uniform thickness.

In one embodiment, the insulation is present within the toe top region and is absent or not present in the upper, toe bottom or foot bottom regions. FIG. 11 shows a side cross-sectional view of one embodiment of a footwear article construction of the present invention having insulation in the toe top region. In this embodiment, the insulation component 940' is oriented outside relative to the footbed 205 and the lining 970. No further insulation is provided in the toe bottom and thus insulation 940 and textile component 950 are not included.

In an optional embodiment, insulation component 940' may be laminated to toe puff 980 to reduce the manufacturing steps and avoid further adhesive layers.

In further embodiments, insulation component 940' may be adjoined with the lining 970 to form a continuous waterproof and breathable lining. A portion of the lining 970 in the toe region is removed and replaced with insulation component 940'. Adjoining the insulation component 940' and lining 970 further reduces the bulk of the shoe. In those embodiments, toe puff 980 is oriented outside relative to the lining 970 and insulation component 940'.

In an alternative embodiment, insulation component 940' may be located within a pocket of the upper material 910. The pocket may have one slit to allow access thereto. The pocket may be resealable to allow replacement or removal of the insulation component 940' or may be adhered once the insulation component 940' is slid inside the pocket. In another embodiment, insulation component 940' could optionally be adjoined by a textile component on one or both sides. In another embodiment, the insulation construct 940' could be attached to either the lining 970, the upper 910, or both by any attachment method. In another embodiment, the insulation construct 940' could be both attached to either the lining 970 or upper 910 or both and adjoined to a textile on one or both sides of the insulation construct 940'.

Test Methods

Thermal Resistance of Footwear

The thermal resistance of footwear articles was measured in accordance with the general teachings of ASTM F1291-10, *Standard Test Method for Measuring the Thermal Insulation of Clothing Using a Heated Manikin*, with a few variations as detailed herein.

The manikin used to conduct the testing on size 42 shoes was a Thermetrics (Seattle, Wash.) 12-Zone High-Top Thermal Foot Test System, sized to represent the $50^{th}$ percent male left foot (US size 9, European size 42). The manikin included twelve independently controlled sweating zones, depicted in FIGS. 1*a-h*, which utilized a distributed temperature sensor network. The twelve zones of the foot manikin were sized and arranged as depicted in Table 1 and in FIGS. 1*a*-1*h*.

TABLE 1

| Zone # | Region | Area, $m^2$ |
|---|---|---|
| 1 | — | 0.0168 |
| 2 | — | 0.0174 |
| 3 | — | 0.0067 |
| 4 | — | 0.0063 |
| 5 | — | 0.0116 |
| 6 | — | 0.0060 |
| 7 | Upper | 0.0037 |
| 8 | Upper | 0.0037 |
| 9 | Upper | 0.0065 |
| 10 | Foot Bottom | 0.0190 |
| 11 | Toe | 0.0046 |
| 12 | Toe | 0.0046 |

The toe top region is zone 11 in Table 1.

The manikin used to conduct the testing on size 37 shoes was a Thermetrics (Seattle, Wash.) 13-Zone High-Top Thermal Foot Test System, sized to represent the $50^{th}$ percent female left foot (US size 7, European size 37). The manikin included thirteen independently controlled sweating zones, depicted in FIGS. 2*a*-2*h*, which utilized a distributed temperature sensor network. The thirteen zones of the foot manikin were sized and arranged as depicted in Table 2 and in FIGS. 2*a*-2*h*.

TABLE 2

| Zone # | Region | Area, $m^2$ |
|---|---|---|
| 13 | — | 0.0065 |
| 14 | — | 0.0067 |
| 15 | — | 0.0108 |
| 16 | Upper | 0.0035 |
| 17 | Upper | 0.0017 |
| 18 | Upper | 0.0018 |
| 19 | Upper | 0.0051 |
| 20 | Foot Bottom | 0.0047 |
| 21 | Foot Bottom | 0.0048 |
| 22 | Upper | 0.0037 |
| 23 | Foot Bottom | 0.0022 |
| 24 | Toe | 0.0031 |
| 25 | Toe | 0.0022 |

The toe top region is zone 24 in table 2.

A climate chamber was used to provide controlled temperature and relatively humidity conditions surrounding the manikin. A custom built wind tunnel surrounding the manikin was used to provide controlled, directional (from toe to heel), uniform air flow. Spatial and temporal variability of air flow was less than 12.5% as measured in the wind tunnel with the foot manikin removed. An omni-directional anemometer with ±0.05 m/s accuracy and time constant less than 1 second was used to measure the air flow at 9 evenly distributed points. These points covered an area 8 inches wide and 9 inches tall centered in the wind tunnel on a plane perpendicular to the air flow and 1.5 inches windward of the foot manikin toe leading edge. Measurements were averaged for at least three minutes at each location.

Testing was conducted in a controlled environment with a temperature of 23±0.5° C., relative humidity of 50%±5%, and air velocity of 1.0±0.05 m/s. A sample to be tested, sized to fit onto the manikin (e.g., left shoe size US 9, European 42), was left to precondition at 23° C., 50% RH for at least 12 hours. This footwear article sample was placed on a nude manikin (i.e., without a sock) and the laces, if present on the footwear article, were tied. The manikin was suspended in air such that there was no external pressure applied to the footwear article by the use of a sole pressure plate or any other device. Data collection was conducted in accordance with ASTM F1291-10. That is, insulation values were determined by averaging 30 minutes of steady-state data in order to obtain a total thermal resistance ($R_t$) with the units of $m^2 \cdot °$ C./W for each zone. The results reported generally represent an average of three measurements of each article. Testing following the same protocol was also conducted on the nude manikin (i.e., without a footwear article) in order to obtain the thermal resistance of the air layer on the surface of the nude manikin ($R_a$) with the units of $m^2 \cdot °$ C./W for each zone.

$R_t$ for each zone was calculated as follows:

$$Rt=(Tskin-Tamb)/(Q/A)$$

Tskin=Zone average temperature (° C.)

Tamb=Ambient temperature (° C.)

Q/A=Heat flux (W/m$^2$)

For testing carried out without a footwear article, $R_a$ was calculated in the same manner.

The footwear thermal resistance ($R_f$) with the units of m$^2$·° C./W was then calculated for several regions by subtracting the thermal resistance of the air layer on the surface of the nude manikin ($R_a$) for the region from the total thermal resistance ($R_t$) for the region. Each zone within each region was included within the calculation, regardless of whether the footwear article covered the entirety of the region. A parallel method of calculation was used for regions which include multiple zones, as illustrated in the following equations. Tables 1 and 2 identifies which zones are included within each region for each manikin.

$$R_{f,region}=R_{t,region}-R_{a,region}$$

where $$R_{t,region}=\Sigma A_{zones}/\Sigma(A_{zones}/R_{t,zones})$$

$$R_{a,region}=\Sigma A_{zones}/\Sigma(A_{zones}/R_{a,zones})$$

For example, the $R_{f,\ upper}$ for the size 42 manikin was calculated as follows, based on Table 1:

$$R_{f,upper}=[(A_6+A_7+A_8+A_9)/(A_6/R_{t,6}+A_7/R_{t,7}+A_8/R_{t,8}+A_9/R_{t,9})]-[(A_6+A_7+A_8+A_9)/(A_6/R_{a,6}+A_7/R_{a,7}+A_8/R_{a,8}+A_9/R_{a,9})]$$

The $R_{f,\ upper}$ for the size 37 manikin was calculated as follows, based on Table 2:

$$R_{f,upper}=[(A_{16}+A_{17}+A_{18}+A_{19}+A_{22})/(A_{16}/R_{t,16}+A_{17}/R_{t,17}+A_{18}/R_{t,18}+A_{19}/R_{t,19}+A_{22}/R_{t,22})]-[(A_{16}+A_{17}+A_{18}+A_{19}+A_{22})/(A_{16}/R_{a,16}+A_{17}/R_{a,17}+A_{18}/R_{a,18}+A_{19}/R_{a,19}+A_{22}/R_{a,22})]$$

Normal experimental error in the measurement of small thermal resistance values can result in zero and/or negative values in such calculations. In the case that the calculated Rf in a region was less than or equal to zero, a minimal value of 0.0001 m2K/W was substituted to avoid dividing by zero errors when calculating footwear thermal resistance ratios as defined below.

Footwear thermal resistance ratios, expressed as unitless values, were calculated as the ratio between the footwear thermal resistance values for the relevant regions as follows:

Toe region to foot bottom region footwear thermal resistance ratio=$R_{f,\ toe}/R_{f,\ foot\ bottom}$. As the average of 3 measurements was used, the average toe region to foot bottom region footwear thermal resistance ratio=average $R_{f,\ toe}$/average $R_{f,\ foot\ bottom}$.

Toe top region to upper region footwear thermal resistance ratio=$R_{f,\ toe\ top}/R_{f,\ upper}$. As the average of 3 measurements was used, the average toe top region to upper region footwear thermal resistance ratio=average $R_{f,\ toe\ top}$/average $R_{f,\ upper}$.

Evaporative Resistance of Footwear

The evaporative resistance of footwear articles was measured in accordance with the general teachings of ASTM F2370-10, *Standard Test Method for Measuring the Evaporative Resistance of Clothing Using a Sweating Manikin*, with a few variations as detailed herein. Two manikins were used to conduct the testing. These were a Thermetrics (Seattle, Wash.) 12-Zone High-Top Thermal Foot Test System sized to represent the 50$^{th}$ percent male left foot (US size 9, European size 42) and a Thermetrics (Seattle, Wash.) 13-Zone High-Top Thermal Foot Test System sized to represent the 50$^{th}$ percent female left foot (US size 7, European size 37). The manikins included multiple independently controlled sweating zones which utilized a distributed temperature sensor network. The zones of the size 42 foot manikin were sized and arranged as depicted in Table 1 and FIGS. 1*a*-1*h* and the zones of the size 37 foot manikin were sized and arranged as depicted in Table 2 and FIGS. 2*a*-2*h*. A climate chamber was used to provide controlled temperature and relatively humidity conditions surrounding the manikin. A custom built wind tunnel surrounding the manikin was used to provide controlled, directional (from front to back), uniform air flow. Spatial and temporal variability of air flow was less than 12.5% as measured in the wind tunnel with the foot manikin removed. An omni-directional anemometer with ±0.05 m/s accuracy and time constant less than 1 second was used to measure the air flow at 9 evenly distributed points. These points covered an area 8 inches wide and 9 inches tall centered in the wind tunnel on a plane perpendicular to the air flow and 1.5 inches windward of the foot manikin toe leading edge. Measurements were averaged for at least three minutes at each location.

Testing was conducted in a controlled environment with a temperature of 35±0.5° C., relative humidity of 40%±5%, and air velocity of 1.0±0.05 m/s. A sample to be tested, sized to fit onto the manikin (e.g., left shoe size US 9, European 42), was left to precondition at 23° C., 50% RH for at least 12 hours. This footwear article sample was placed on the sweating manikin and the laces, if present, were tied. The sweating manikin was covered by a removable fabric sweating skin, used to distribute water evenly over the manikin surface, prior to the placement of the footwear article on the manikin. This skin was pre-wet before mounting the shoe on the manikin. The manikin was suspended in air such that there was no external pressure applied to the footwear article by the use of a sole pressure plate or any other device. Data collection was conducted in accordance with ASTM F2370-10 per option 1 in section 8.6 by measuring heater wattage (power) over the test period. That is, 30 minutes of steady-state data was averaged in order to obtain a total evaporative resistance ($R_{et}$) with the units of m$^2$·Pa/W for each zone. The results reported represent an average of three measurements of each article. Testing following the same protocol was also conducted on the manikin tested with only the removable fabric sweating skin in place (i.e. without a footwear article) in order to obtain the evaporative resistance of the air layer on the surface of the nude manikin ($R_{ea}$) with the units of m$^2$·Pa/W for each zone.

$R_{et}$ for each zone was calculated as follows:

$$Ret=(Psat-Pamb)/(Q/A)$$

Psat=Saturation vapor pressure at measured skin temperature (Pa)

Pamb=Ambient vapor pressure at measured ambient temperature (Pa)

Q/A=Heat flux (W/m$^2$)

The vapor pressure was calculated as follows:

$$Psat=133.3\cdot10^{[8.10765-(1750.29/(235+Tskin))]}$$

$$Pamb=RH\cdot0.01\cdot133.3\cdot10^{[8.10765-(1750.29/(235+Tamb))]}$$

Psat=Saturation vapor pressure (Pa)

Pamb=Ambient vapor pressure (Pa)

Tskin=Skin temperature (° C.)

Tamb=Ambient temperature ° C.)

RH=Ambient Relative Humidity (%)

For testing carried out on the manikin without a footwear article, $R_{ea}$ was calculated in the same manner.

The footwear evaporative resistance ($R_{ef}$) with the units of $m^2 \cdot Pa/W$ was then calculated for the upper region by subtracting the evaporative resistance of the air layer on the surface of the nude manikin ($R_{ea}$) for the region from the total evaporative resistance ($R_{et}$) for the region. The upper region includes the zones indicated as "upper" in Tables 1 and 2 for the corresponding foot manikin. Each zone within the upper region was included within the calculation, regardless of whether the footwear article covered the entirety of the region. A parallel method of calculation was used to calculate the upper region footwear evaporative resistance as follows for testing on the size 42 manikin:

$$R_{ef,upper}=[(A_6+A_7+A_8+A_9)/(A_6/R_{et,6}+A_7/R_{et,7}+A_8/R_{et,8}+A_9/R_{et,9})]-[(A_6+A_7+A_8+A_9)/(A_6/R_{ea,6}+A_7/R_{ea,7}+A_8/R_{ea,8}+A_9/R_{ea,9})]$$

The evaporative resistance for testing on the size 37 manikin was calculated as follows:

$$R_{ef,upper}=[(A_{16}+A_{17}+A_{18}+A_{19}+A_{22})/(A_{16}/R_{et,16}+A_{17}/R_{et,17}+A_{18}/R_{et,18}+A_{19}/R_{et,19}+A_{22}/R_{et,22})]-[(A_{16}+A_{17}+A_{18}+A_{19}+A_{22})/(A_{16}/R_{ea,16}+A_{17}/R_{ea,17}+A_{18}/R_{ea,18}+A_{19}/R_{ea,19}+A_{22}/R_{ea,22})]$$

Thermal Conductivity

Thermal conductivity of insulation used in the present invention was measured with a Laser Comp Model Fox 314 thermal conductivity analyzer. (Laser Comp Saugus, Mass.). The result of a single measurement was recorded.

Thickness

Sample thickness was measured with the integrated thickness measurement of the thermal conductivity instrument. (Laser Comp Model Fox 314 Laser Comp Saugus, Mass.). The result of a single measurement was recorded.

Footwear Centrifuge Waterproofness Test

Waterproofness for each footwear sample can be determined by use of the Centrifuge test described in U.S. Pat. No. 5,329,807 to Sugar, et al. assigned to W.L. Gore and Associates, Inc. and incorporated by reference herein in its entirety. The centrifuge tests are carried out for 30 minutes. The footwear sample is considered to be waterproof if no leakage is seen after 30 minutes.

Gas Permeability Measured by Methane Permeation

The methane tester is a diffusion setup with no back pressure in the system. The main part of the device is a cell made of stainless steel consisting of two halves. The testing film is sandwiched between the two halves. Tight seal is guaranteed by two o-rings. The cell has two outlets and two inlets. Methane gas comes in from the bottom inlet and comes out through the bottom exhaust outlet, which ensures that there is no back pressure on the film. The methane flow is controlled by a needle valve. On the top, the zero air comes in from the top inlet and takes methane gas permeated through the sample film to the FID detector. Zero air is the compressed air passing through a catalyst bed to be rid of any hydrocarbons in the air so that the methane is the only hydrocarbon the FID detector measures. In the actual device, more controls are needed for flexible detection range and ease of measurement. The FID detector of the methane permeation tester is calibrated by the mixture of air and methane with known concentrations. Due to relatively large sample footprint needed for the test (about 4" in diameter) and limited sample size, only two replicates were tested in most cases.

The bottom of the cell is purged by the zero air before the film is fixed between the two halves of the cell. Then the methane will be turned on after the data acquisition software is started. The duration of the test is typically 15 minutes to make sure the signal reaches steady state. The data acquisition frequency is 1 Hz. The FID voltage is calculated by averaging the data in the last two minutes. The methane concentration ($C_{methane}$) is then determined by the FID voltage and the calibration curve. The methane flux can be calculated then by the following equation:

$$\text{Methane flux}=C_{methane}(\text{ppm})*R(\text{ml/min})/A(\text{cm}^2)=0.000654*C_{methane}*R/A(\mu\text{g/cm}^2/\text{min})$$

in which $C_{methane}$ is the methane concentration in ppm, R is the flow rate of zero air in ml/min and A is the area of the cell in $cm^2$. The constant 0.000654 comes from the conversion from volume to mass of methane.

Compression

The % strain resulting from compressive stresses was measured using cylindrical compression plates on Instron Model 5965 Dual Column Tabletop Testing System equipped with a compression fixture and a 5 kN load cell (Instron High Wycombe, UK). The starting thickness of an 18 mm diameter sample was measured at a load of 0.05 kgf. This sample was then compressed at a rate of 0.1 mm/sec. After correcting for the compliance of the instrument, the strains at a stress of 300 kPa and 2000 kPa were measured. An average of 3 measurements was recorded to determine the compression resistance value.

EXAMPLES

Inserts for footwear article in accordance with Examples 1-3, and 5 of the present invention were created in the following manner.

Referring to FIG. 4, described earlier herein, a top view of a conventional footbed 205 for a shoe, wherein the region 311 defines the footbed toe between the dotted lines. FIG. 5 shows a side cross-sectional perspective view of the conventional footbed 205. For each example shown in Table 2, the footbed 205 was first removed from the shoe. A 7 cm distance measured from the frontmost point of the footbed 312 defined the footbed toe region 311. The footbed toe region 311 was cut off of the footbed 205, thereby forming a footbed rear section 320. The removed footbed toe region 311 was used as a pattern to cut out a substantially identically sized piece of insulation material. The insulation material used for Examples 1-3 and 5 was made generally in accordance with the teachings of U.S. Pat. No. 7,118,801, and comprised a PTFE-aerogel composite material having a thermal conductivity from 0.0152 W/mK to 0.0246 W/mK and a thickness of 2.0 mm. Examples were made with materials having strains of less than 40%, for example 18.5% at 300 kPa and strains of less than 55%, for example 39% at 2000 kPa. This insulation material was covered on both sides with a covering layer comprising a 0.08 mm thick, 30.5 $g/m^2$ nonwoven nylon textile using a spray adhesive (3M Model #77-CC) to adhere the textile to the insulation material. The textile was then trimmed so that an approximately 1.5 cm boundary of textile surrounded the insulation material. FIG. 6 shows a schematic cross-section view of the insulation material wherein the insulation 501 is within and surrounded by the two outer covering layers, in this example the textile, 502*a* and 502*b*. This combination of insulation material and textile is referred to as the insulation construct 503 or 503'. The insulation construct 503' used in the upper portion of the shoe may sometimes be referred to herein as the "upper insulation construct," and the insulation construct used in the footwear bottom region of the shoe may sometimes be referred to as the "sole insulation construct."

Referring to FIG. 7*a*, to install the insulation construct into the shoes for Examples 2 and 3, a first insulation construct 503 was laid out in front of the footbed rear section 320, thereby substantially recreating the shape of the original footbed 205. An additional piece of nonwoven nylon 630, similar to that described for the covering layer, was laid on top of the footbed rear section 320 and the insulation construct 503 so that it spanned the interface to hold the two pieces 320 and 503 together and overlapped both the footbed material rear section 320 and the insulation construct 503. The nonwoven textile, footbed material, and sole insulation construct were all then adhered to each other using the spray adhesive described earlier, thereby forming a modified footbed 650.

For the shoe of Examples 1 and 5, and referring to FIG. 7*b*, where the original footbed 205 was more than 0.5 mm thicker than the insulation construct 503, a spacer 640, such as a piece of polyethylene foam (RG 170 as manufactured by HIRI-Hildebrand and Richter & Co.), was attached using the same adhesive such that the total thickness of the insulation construct 503 plus spacer 640 was approximately equivalent to the thickness of the footbed rear section 320. A nonwoven nylon textile 630 as described for FIG. 6A, above, was used to hold the pieces 320, 640 and 503 together. In this manner, a modified footbed 651 for Examples 1 and 5 was created.

The modified footbed, 650 or 651, was then reinserted into the shoe, filling an identical shoe cavity space as the original, unmodified footbed which had been removed.

An additional insulation construct 503' was created to fit to the upper portion of the toe cavity of the shoe using identical insulation, nonwoven material and assembly technique as described above, and as depicted in FIG. 6; however the shape of this insulation construct was cut in a dome-like shape as shown in FIG. 9 to conform generally to the upper toe region, with the curved edge oriented to be placed toward the front of the shoe and generally contacting the front edge 311 of the modified footbed 650. The piece of insulation was sized to extend at least 7 cm back from the front most point of the shoe 711, when measuring generally along the top surface of the shoe, as depicted by the arrow extending between the dotted lines 720 in FIG. 8. The top surface of this insulation construct was then sprayed with the adhesive described above and inserted into the toe cavity of the shoe such that there was a minimal gap between the insulation construct 503 in the footbed and the insulation construct 503' in the toe region of the upper. Testing of the footwear articles of Examples 1-6 was carried out and reported in Table 3 and 4 below. As well, testing of the unmodified Comparative Examples 1-7 was carried out and reported in Tables 3 and 4. Two other commercially available shoes were tested in Comparative Examples 6 and 7 without any modification or additional insulation.

TABLE 3

| | Footwear Model | Insulation in Toe Top Region | Low Bulk Insulation* | Upper Rf ($m^{2\circ}$ C./W) | Foot Bottom Rf ($m^{2\circ}$ C./W) | Toe Top Rf ($m^{2\circ}$ C./W) | Toe Rf ($m^{2\circ}$ C./W) |
|---|---|---|---|---|---|---|---|
| Examples | | | | | | | |
| Example 1 | Converse Chuck Taylor ™ All Star ™ '70 Hi with insulation construct | Yes | Yes | 0.043 | 0.095 | 0.121 | 0.128 |
| Example 2 | Timberland ™ Earthkeepers Mosley ™ Boot with insulation construct | Yes | Yes | 0.065 | 0.114 | 0.137 | 0.149 |
| Example 3 | Belleville ™ 790 ™ Waterproof Flight and Combat Boot with insulation construct | Yes | Yes | 0.074 | 0.153 | 0.131 | 0.152 |
| Example 4 | Custom designed women's casual leather boot | Yes | Yes | 0.077 | 0.118 | 0.098 | 0.122 |
| Example 5 | Sam Edelman ™ Felicia ™ Ballerina Flat with insulation construct | Yes | Yes | 0.0001 | 0.125 | 0.126 | 0.132 |
| Example 6 | Leather Ankle Boot | Yes | Yes | 0.041 | 0.114 | 0.108 | 0.114 |
| Comparative Examples | | | | | | | |
| Comparative Example 1 | Converse Chuck Taylor ™ All Star ™ '70 Hi | No | Yes | 0.028 | 0.109 | 0.038 | 0.065 |
| Comparative Example 2 | Timberland ™ Earthkeepers Mosley ™ Boot | No | Yes | 0.058 | 0.104 | 0.054 | 0.066 |
| Comparative Example 3 | Belleville ™ 790 ™ Waterproof Flight and Combat Boot | No | Yes | 0.068 | 0.151 | 0.061 | 0.086 |
| Comparative Example 4 | Skiboot | Yes | No | 0.190 | 0.200 | 0.176 | 0.169 |
| Comparative Example 5 | Sam Edelman ™ Felicia ™ Ballerina Flat | No | Yes | 0.0004 | 0.131 | 0.047 | 0.072 |
| Comparative Example 6 | Rocky ™ S2V Resection ™ Athletic Trail Shoe | Yes | Yes | 0.144 | 0.205 | 0.133 | 0.146 |
| Comparative Example 7 | Salomon ™ Toundra Mid WP ™ | Yes | No | 0.191 | 0.235 | 0.150 | 0.159 |

*Upper Rf < 0.18 m2° C./W

TABLE 4

| | Footwear Model | Toe Rf to Foot Bottom Rf Ratio | Toe Top Rf to Upper Rf Ratio | Low Upper w/out toe Ref ($m^2 \cdot Pa/W$) |
|---|---|---|---|---|
| Examples | | | | |
| Example 1 | Converse Chuck Taylor ™ All Star ™ '70 Hi with insulation construct | 1.35 | 2.81 | 6.8 |
| Example 2 | Timberland ™ Earthkeepers Mosley ™ Boot with insulation construct | 1.31 | 2.11 | 332.1 |
| Example 3 | Belleville ™ 790 ™ Waterproof Flight and Combat Boot with insulation construct | 0.99 | 1.77 | 34.8 |
| Example 4 | Custom designed women's casual leather boot | 1.03 | 1.27 | 25.4 |
| Example 5 | Sam Edelman ™ Felicia ™ Ballerina Flat with insulation construct | 1.06 | 1260.00 | 1.7 |
| Example 6 | Leather Ankle Boot | 1.00 | 2.63 | — |
| Comparative Examples | | | | |
| Comparative Example 1 | Converse Chuck Taylor ™ All Star ™ '70 Hi | 0.60 | 1.36 | 4.5 |
| Comparative Example 2 | Timberland ™ Earthkeepers Mosley ™ Boot | 0.63 | 0.93 | 411.2 |
| Comparative Example 3 | Belleville ™ 790 ™ Waterproof Flight and Combat Boot | 0.57 | 0.90 | 35.4 |
| Comparative Example 4 | Skiboot | 0.85 | 0.93 | 11304.5 |
| Comparative Example 5 | Sam Edelman ™ Felicia ™ Ballerina Flat | 0.55 | 117.50 | 1.3 |
| Comparative Example 6 | Rocky ™ S2V Resection ™ Athletic Trail Shoe | 0.71 | 0.92 | 177.7 |
| Comparative Example 7 | Salomon ™ Toundra Mid WP ™ | 0.68 | 0.79 | 521.2 |

Example 4

A women's casual style mid-height boot was created as described below and depicted schematically in FIG. 10. The boot was made using a leather upper 910 and a milled sole consisting of ethylene vinyl acetate (EVA) 920. The leather was 1.2 mm to 1.4 mm bovine full grain. The sole was approximately 10 mm thick in the forefoot and 28 mm thick at the heel. A cellulosic insole board 930 was used with a shank board reinforcement in the heel area (not shown). A piece of approximately 2 mm thick low thermal conductivity insulation made generally in accordance with the teachings of U.S. Pat. No. 7,118,801, and comprising a PTFE-aerogel composite material having a thermal conductivity of 0.020 W/mK 940 was cut in the shape of the toe area of the insole board 930 to extend back from the front of the shoe 911 approximately the same distance as the toe puff 980. This piece of insulation was adhered with neoprene adhesive to the top of the toe area of the insole board. A piece of non-woven polyester textile 950 was cut to the shape of the remaining area of the insole board and was adhered with neoprene adhesive to the top of the remaining area of the insole board to form a surface of approximately uniform thickness.

The pattern of the boot upper 910 was designed to accommodate the additional thickness of insulation in the toe puff 980 and insole board 930 areas while maintaining a lasting margin of 1.8 cm all around the bottom of the insole board 930. After the leather was stitched into the desired shape of the upper 910, a heel counter 960 and a three layer textile laminate (polyimide-polyester blend knit textile/ePTFE/polyamide knit) lining 970 were incorporated. A toe puff 980 consisting of a polyester textile coated with an acrylic polymer was adhered to the inside of the leather upper with neoprene adhesive. A separate piece of the low thermal conductivity insulation material described above measuring approximately 2 mm thick with a thermal conductivity of approximately 20 mW/m K 940' was cut to approximately match the dimensions of the toe puff 980 and was skived to a width of approximately 2 cm around the upper side of the toe box and 1.5 cm around the lasting margin in order to reduce any visible transition at the edge of the material. The insulation was then adhered with neoprene adhesive to the inside of the toe puff 980. The upper was then force lasted and adhered to the insole board using a neoprene adhesive. Finally, the sole 920 was cemented to the closed upper using a polyurethane adhesive and a membrane pneumatic press. Testing of the finished shoe was carried out as described earlier herein, and the results are reported in Tables 3 and 4.

While this example describes what is referred to as a force lasted upper with a cemented sole shoe construction, it would be appreciated that this invention could be achieved in other shoe construction techniques including, but not limited to, shoes with Strobeled, stitch down, tubular moccasin and slip lasted uppers and shoes with injection molded soles, vulcanized soles, leather soles, EVA soles, and the like.

Example 6

A women's casual style mid-height boot was created as described below and depicted schematically in FIG. 10. The boot was made using a leather upper 910 and a cemented sole 920. A piece of approximately 1.9 mm thick low thermal conductivity insulation made generally in accordance with the teachings of U.S. Pat. No. 7,118,801, and comprising a PTFE-aerogel composite material having a thermal conductivity of 0.020 W/mK 940 was cut in the shape of the toe area of the insole board 930 to extend back from the front of the shoe 911 approximately the same distance as the toe puff 980. This piece of insulation was adhered to the top of the toe area of the insole board. A spacer 950 was cut to the shape of the remaining area of the insole board and was adhered to the top of the remaining area of the insole board to form a surface of approximately uniform thickness.

The pattern of the boot upper 910 was designed to accommodate the additional thickness of insulation in the toe puff 980 and insole board 930 areas while maintaining a lasting margin all around the bottom of the insole board 930. After the leather was stitched into the desired shape of the upper 910, a heel counter 960 and a lining 970 were incorporated. A toe puff 980 was adhered to the inside of the leather upper with neoprene adhesive. A separate piece of the low thermal conductivity insulation material described above measuring approximately 1.9 mm thick with a thermal conductivity of approximately 0.020 W/mK 940' was cut to approximately match the dimensions of the toe puff 980 and was skived around the upper side of the toe box and around the lasting margin in order to reduce any visible transition at the edge of the material. The insulation was then adhered to the inside of the toe puff 980. The upper was then force lasted and adhered to the insole board. Finally, the sole 920 was cemented to the closed upper. Testing of the finished shoe was carried out as described earlier herein, and the results are reported in Tables 3 and 4.

While this example describes what is referred to as a force lasted upper with a cemented sole shoe construction, it would be appreciated that this invention could be achieved in other shoe construction techniques including, but not limited to, shoes with strobeled, stitch down, tubular moccasin and slip lasted uppers and shoes with injection molded soles, vulcanized soles, leather soles, EVA soles, and the like.

Comparative Example 4

A skiboot was formed substantially in accordance with the teachings of Example 1 of U.S. Pat. No. 7,752,776, to Farnworth. Specifically, the insulation value of the toe area of a ski boot was increased generally in accordance with Example 1 of Farnworth (U.S. Pat. No. 7,752,776) with a few minor exceptions. Namely, an insulating material substantially described as in Farnworth, with the addition of an outer vacuum sealed film (Ziploc® Vacuum sealer roll film (part number ZL211X16PK6)) to ensure the vacuum sealing in the insulation. The insulation value of the insulating vacuum structure covering the bottom front part of the foot was 0.35 $m^2$ K/W, and the insulation value of the insulation structure covering a portion of the top part of the foot was 0.36 $m^2$ K/W.

Testing of the finished shoe was carried out as described earlier herein, and the results are reported in Tables 3 and 4.

It will be appreciated by those skilled in the pertinent art that the units of W/mK are equivalent to the units of W/m° C. and the units of $m^{2\circ}$ C./W are equivalent to the units of $m^2$K/W.

The invention of this application has been described above both generically and with regard to specific embodiments. Although the invention has been set forth in what is believed to include certain preferred embodiments, a variety of alternatives known to those of skill in the art can be selected to be within the generic disclosure. The invention is not otherwise limited, except for the recitation of the claims set forth below.

We claim:

1. A footwear article comprising an upper region, a toe region comprising a toe top region and toe bottom region, and a foot bottom region, wherein said footwear article has a footwear thermal resistance $R_f$ of said upper region of 0.18 $m^{2\circ}$ C./W or less;

a low bulk insulation with a thermal conductivity of 30 mW/m° C. or less in said toe top region; and has a footwear thermal resistance ratio of said toe region to said foot bottom region of 0.80 or greater.

2. The footwear article of claim 1, wherein said footwear thermal resistance $R_f$ of said upper region is 0.16 $m^{2\circ}$ C./W or less.

3. The footwear article of claim 1, wherein said footwear thermal resistance $R_f$ of said upper region is 0.1 $m^{2\circ}$ C./W or less.

4. The footwear article of claim 1, wherein said footwear thermal resistance ratio of said toe region to said foot bottom region is 1.0 or greater.

5. The footwear article of claim 1, wherein said footwear article is waterproof.

6. The footwear article of claim 1, wherein at least a portion of the upper region is covered by a material.

7. The footwear article of claim 1, wherein said footwear article has a footwear evaporative resistance of said upper region is 250 $m^2$·Pa/W or less.

8. The footwear article of claim 1, wherein said footwear article has a footwear evaporative resistance of said upper region is 100 $m^2$·Pa/W or less.

9. The footwear article of claim 1, wherein said low bulk insulation comprises an aerogel containing material.

10. The footwear article of claim 1, wherein said low bulk insulation has a thickness of less than or equal to 5 mm.

11. The footwear article of claim 1, wherein said low bulk insulation has a compression resistant value of less than 40% strain at a stress of 300 kPa.

12. The footwear article of claim 1, wherein said low bulk insulation has a compression resistant value of less than 55% strain at a stress of 2000 kPa.

13. The footwear article of claim 1, wherein said low bulk insulation is gas permeable.

14. The footwear article of claim 1, wherein said footwear thermal resistance ratio of said toe region to said foot bottom region is 1.0 or greater.

15. A low bulk footwear article comprising a toe top region and an upper region, wherein said footwear article has a footwear thermal resistance $R_f$ of said upper region of 0.18 $m^{2\circ}$ C./W or less;

a low bulk insulation with a thermal conductivity of 30 mW/m° C. or less in said toe top region; and has a footwear thermal resistance ratio of said toe top region to said upper region of 1.0 or greater.

16. The footwear article of claim 15, wherein said footwear thermal resistance $R_f$ of said upper region is 0.16 $m^{2\circ}$ C./W or less.

17. The footwear article of claim 15, wherein said footwear thermal resistance $R_f$ of said upper region is 0.1 $m^{2\circ}$ C./W or less.

18. The footwear article of claim 15, wherein said footwear thermal resistance ratio of said toe region to said foot bottom region is 1.4 or greater.

19. The footwear article of claim 15, wherein said footwear article is waterproof.

20. The footwear article of claim 15, wherein said footwear article has a footwear evaporative resistance of said upper region is 250 $m^2$·Pa/W or less.

21. The footwear article of claim 15, wherein said footwear article has a footwear evaporative resistance of said upper region is 100 $m^2 \cdot Pa/W$ or less.

22. The footwear article of claim 15, wherein said low bulk insulation comprises an aerogel containing material.

23. The footwear article of claim 15, wherein said low bulk insulation has a thickness of less than or equal to 5 mm.

24. The footwear article of claim 15, wherein said low bulk insulation has a compression resistance value of less than 40% strain at a stress of 300 kPa.

25. The footwear article of claim 15, wherein said low bulk insulation has a compression resistance value of less than 55% strain at a stress of 2000 kPa.

26. The footwear article of claim 15, wherein said low bulk insulation is gas permeable.

27. A footwear article comprising a toe top region and an upper region, wherein said footwear article incorporates low bulk insulation with a thermal conductivity of 30 mW/m° C. or less in said toe top region; and wherein said footwear article has a footwear evaporative resistance of said upper region of 150 $m^2 \cdot Pa/W$ or less.

28. The footwear article of claim 27, wherein said footwear evaporative resistance of said upper region is 100 $m^2 \cdot Pa/W$ or less.

29. The footwear article of claim 27, wherein said footwear article has a footwear thermal resistance $R_f$ of said upper region of 0.18 $m^{2\circ}$ C./W or less.

30. The footwear article of claim 27, wherein said footwear article has a footwear thermal resistance $R_f$ of said upper region of 0.1 $m^{2\circ}$ C./W or less.

* * * * *